US011905972B2

(12) United States Patent
Kim et al.

(10) Patent No.: US 11,905,972 B2
(45) Date of Patent: Feb. 20, 2024

(54) HEAD MOUNTED FAN

(71) Applicants: Dong Ju Kim, Seoul (KR); Woo-Hyun Kim, Seoul (KR)

(72) Inventors: Dong Ju Kim, Seoul (KR); Woo-Hyun Kim, Seoul (KR)

( * ) Notice: Subject to any disclaimer, the term of this patent is extended or adjusted under 35 U.S.C. 154(b) by 15 days.

(21) Appl. No.: 17/899,827

(22) Filed: Aug. 31, 2022

(65) Prior Publication Data

US 2023/0120339 A1 Apr. 20, 2023

(30) Foreign Application Priority Data

Sep. 1, 2021 (KR) ..... 10-2021-0116081

(51) Int. Cl.

| | |
|---|---|
| ***F04D 25/08*** | (2006.01) |
| ***F04D 29/60*** | (2006.01) |
| ***F04D 29/64*** | (2006.01) |
| ***F04D 25/16*** | (2006.01) |

(52) U.S. Cl.

CPC ..... *F04D 29/601* (2013.01); *F04D 25/08* (2013.01); *F04D 25/166* (2013.01); *F04D 29/646* (2013.01)

(58) Field of Classification Search

CPC ..... F04D 25/06; F04D 25/08; F04D 25/166; F04D 29/646; A41D 13/0053; A41D 13/0025; A41D 13/005; A61F 2007/0002; A61F 2007/0003; A61F 2007/0007; A61F 2007/0008

See application file for complete search history.

(56) References Cited

U.S. PATENT DOCUMENTS

| | | | | |
|---|---|---|---|---|
| 6,125,636 A * | 10/2000 | Taylor | ..... | H10N 10/00 62/3.5 |
| 6,189,327 B1 * | 2/2001 | Strauss | ..... | A41D 13/0025 62/259.3 |
| 2021/0368872 A1 * | 12/2021 | Lee | ..... | F04D 25/084 |

FOREIGN PATENT DOCUMENTS

| | | | | |
|---|---|---|---|---|
| JP | H06-192908 A | 7/1994 | | |
| JP | 3218381 U | 10/2018 | | |
| KR | 20-0363370 Y1 | 10/2004 | | |
| KR | 20-0487688 Y1 | 10/2018 | | |
| KR | 20-2021-0001758 U | 7/2021 | | |
| WO | WO-2019093567 A1 * | 5/2019 | ..... | F04D 25/08 |

* cited by examiner

*Primary Examiner* — Michael L Sehn

(74) *Attorney, Agent, or Firm* — Maier & Maier, PLLC

(57) ABSTRACT

A head mounted fan includes: a main blowing tube configured to be mounted on an upper portion of a head of a user, the main blowing tube having an air inlet through which air is introduced and including a main flow path through which air flows therein; a sub blowing tube connected to the main blowing tube, wherein the sub blowing tube includes a plurality of sub flow paths branching from the main flow path to extend in one direction of the head when the head mounted fan is worn on the head, and wherein air is discharged toward a scalp of the head through a plurality of air outlets communicating with the sub flow paths; and a wind generating unit configured to provide air pressure for causing the air to flow in the main flow path.

10 Claims, 12 Drawing Sheets

HEAD MOUNTED FAN

TECHNICAL FIELD

The present disclosure relates to a head mounted fan.

BACKGROUND

Due to the development of technology, portable fans that are small and easy to carry are widely used.

However, in the case of a portable fan, since a user needs to continuously hold the portable fan, it is difficult to hold the portable fan for a long time, and since the user cannot hold the portable fan while holding objects in both hands, the use of the portable fan may become impossible.

In order to solve the problem of such a portable fan, in the prior art, a neckband type fan through which a user can take wind of the fan without holding it has been proposed.

The conventional neckband type fan, however, can provide wind concentrated only on a user's neck, so it is difficult to supply cool wind to the scalp, which sweats much more than the neck or face. When cool wind is blown to the scalp, the user can feel the coolness much more than when wind is blown to the face or neck, and it is possible to reduce symptoms of hair loss caused by heat stimulation applied to the scalp.

SUMMARY

In view of the above, embodiments of the present disclosure provides a head mounted fan capable of supplying cool wind to the scalp of a user.

In accordance with one aspect of the present disclosure, there is provided a head mounted fan including: a main blowing tube configured to be mounted on an upper portion of a head of a user, the main blowing tube having an air inlet through which air is introduced and including a main flow path through which air flows therein; a sub blowing tube connected to the main blowing tube, wherein the sub blowing tube includes a plurality of sub flow paths branching from the main flow path to extend in one direction of the head when the head mounted fan is worn on the head, and wherein air is discharged toward a scalp of the head through a plurality of air outlets communicating with the sub flow paths; and a wind generating unit configured to provide air pressure for causing the air to flow in the main flow path.

Further, the head mounted fan may further includes: a plurality of elastic members disposed to be spaced apart from each other in a longitudinal direction on a lower surface of the main blowing tube to be located in a space between the head and the main blowing tube, and the wind generating unit may be installed in an end portion of the main blowing tube to face the air inlet.

Further, the head mounted fan may further include: a hat shade for blocking sunlight; and a clamping unit serving to attach the hat shade to a front portion of the main blowing tube, and the clamping unit may include: a hole portion provided at the front portion of the main blowing tube; and a ring portion provided at a rear portion of the hat shade and configured to be fixed by being fitted into the hole portion.

Further, the head mounted fan may further include: a pair of connecting rings provided at both ends of the main blowing tube; and a necklace strap connecting the pair of connecting rings to each other to maintain the head mounted fan separated from the head hung on the neck of the user.

Further, the head mounted fan may further include: an earring bar installed at an end of the main blowing tube to be hung on an ear of the user when the main blowing tube is mounted on the head.

Further, the head mounted fan may further include: a battery provided in the main blowing tube to supply power to the wind generating unit; and a control switch electrically connected between the battery and the wind generating unit to control an operation and on/off of the wind generating unit.

Further, the sub blowing tube may include: a sub tube part connected to the main blowing tube; an air discharge part branched in one direction of the head from the sub tube part, and including a plurality of air outlets; and a guide wall part formed to guide air introduced from the main blowing tube to the air discharge part.

Further, the air discharge part may include: a pair of first air discharge parts extending from a central portion of the sub tube part in parallel toward a rear side of the head; and a pair of second air discharge parts extending from both ends of the sub tube part in parallel toward the rear side of the head, and the guide wall part may include: a first guide wall part provided at a center of the sub tube part, and providing an inner wall that is curved to be continuous with an inner wall of each of the first air discharge parts to guide the air from the main blowing tube to the first air discharge parts; and a second guide wall part provided at a point of the sub tube part from which each of the second discharge parts branches, and providing an inner wall that is curved to be continuous with an inner wall of each of the second discharge parts to guide the air from the main blowing tube to the second discharge parts.

Further, the sub blowing tube may be mounted at the main blowing tube to be rotatable in an up-down direction.

Further, the main blowing tube may include: a first main blowing tube coupled to one end of the sub blowing tube and providing a first fan seating portion to which the wind generating unit is mounted; and a second main blowing tube coupled to the other end of the sub blowing tube and providing a second fan seating portion to which the wind generating unit is mounted, and a plurality of blowing holes for discharging air toward the scalp of the head may be formed in the first main blowing tube and the second main blowing tube.

According to embodiments of the present disclosure, since cool wind can be blown directly to the scalp through the air discharge part of the sub blowing tube inserted into the hairs, the user can feel cool on the scalp, and it can also be of great help to the user's scalp health.

DETAILED DESCRIPTION

Figure 1:
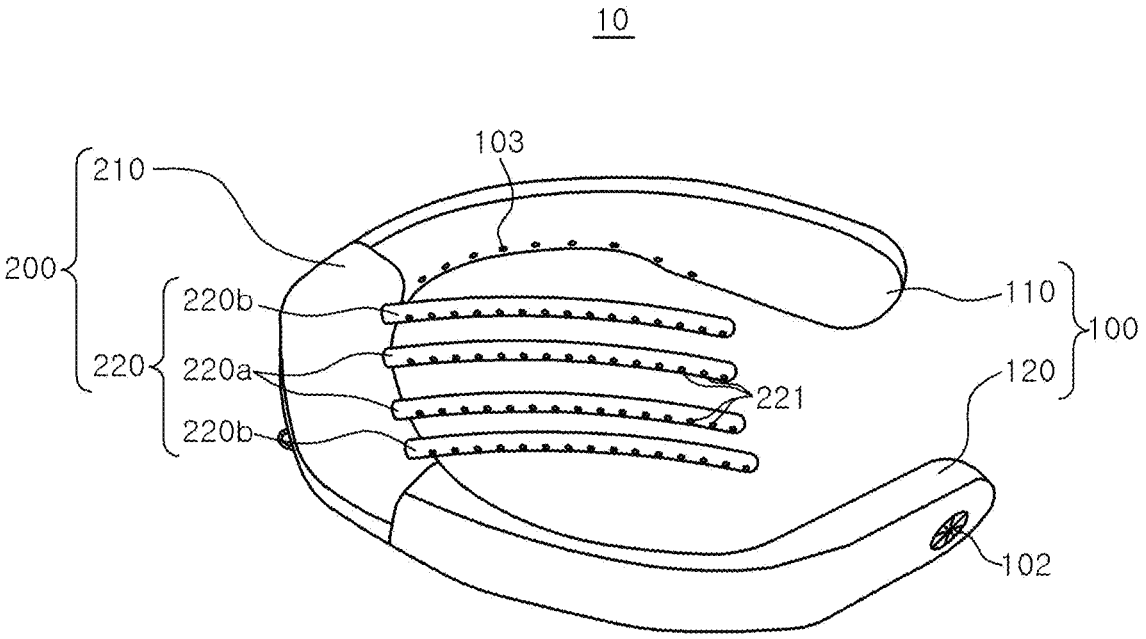
FIG. 1 is a perspective view showing a head mounted fan according to a first embodiment of the present disclosure.
Figure 2:
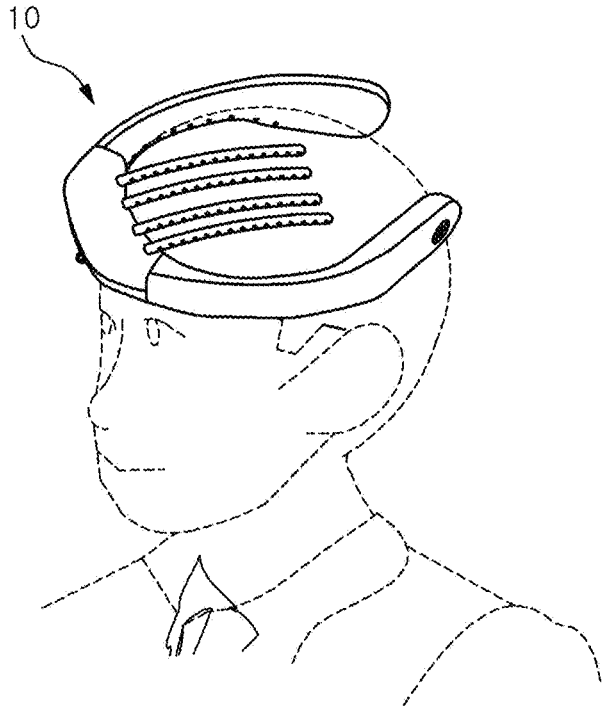
FIG. 2 is a state diagram showing a state in which a user wears the head mounted fan according to the first embodiment of the present disclosure on the head.
Figure 3:
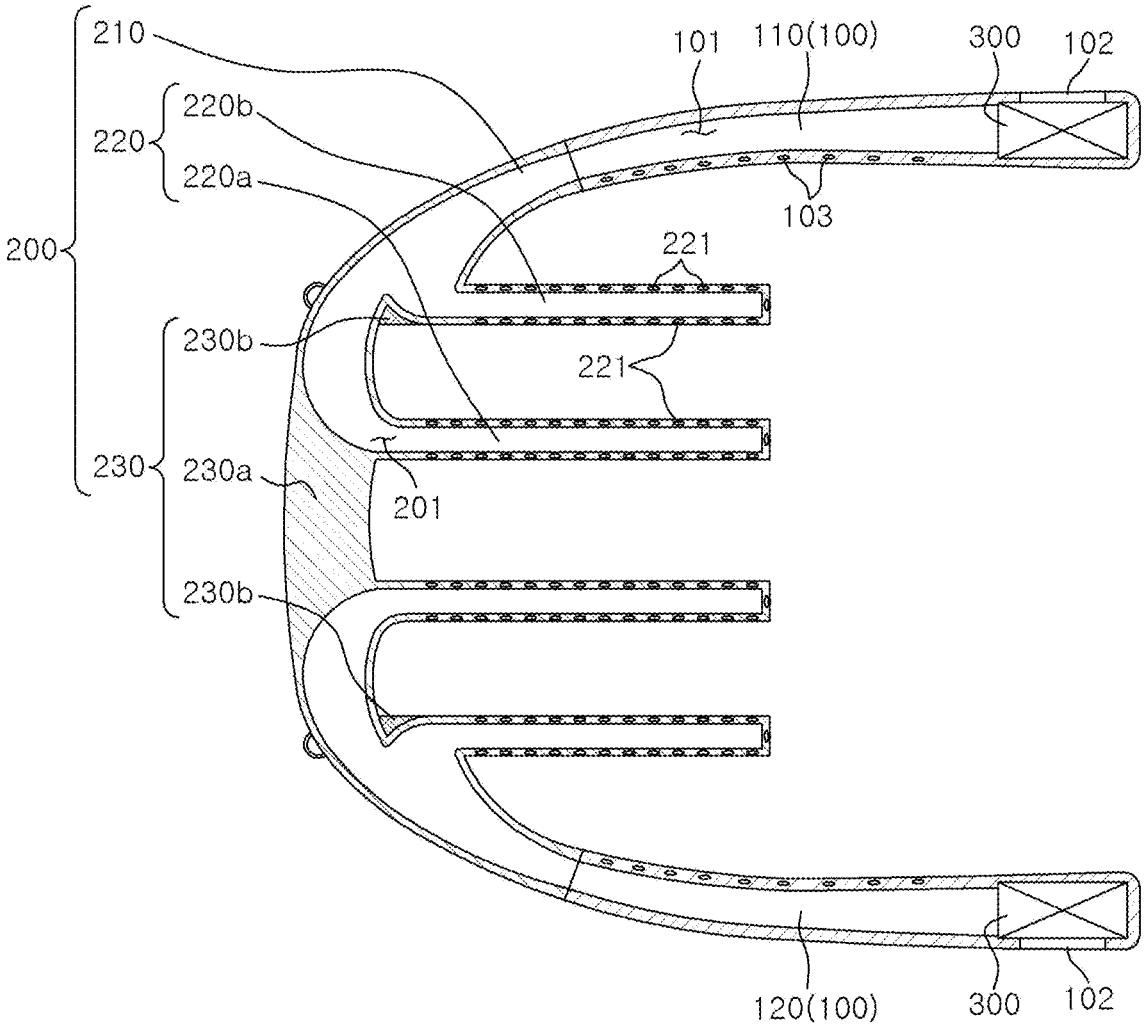
FIG. 3 is a cross-sectional view showing the head mounted fan cut in a transverse direction according to the first embodiment of the present disclosure.
Figure 4:
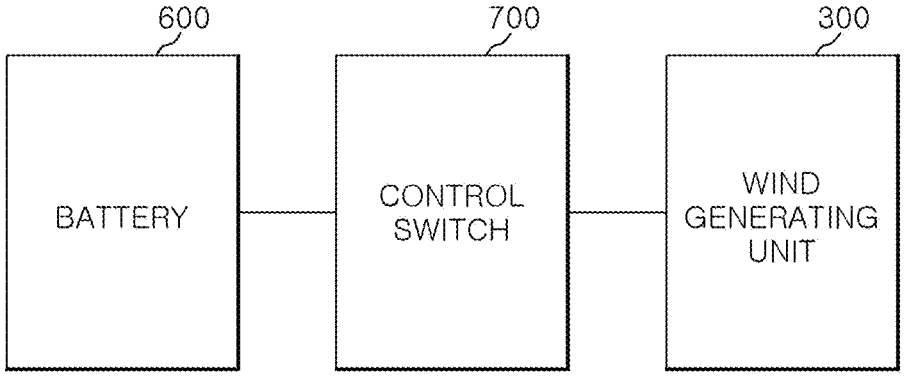
FIG. 4 is a block diagram showing a control flow of the head mounted fan according to the first embodiment of the present disclosure.
Figure 5:
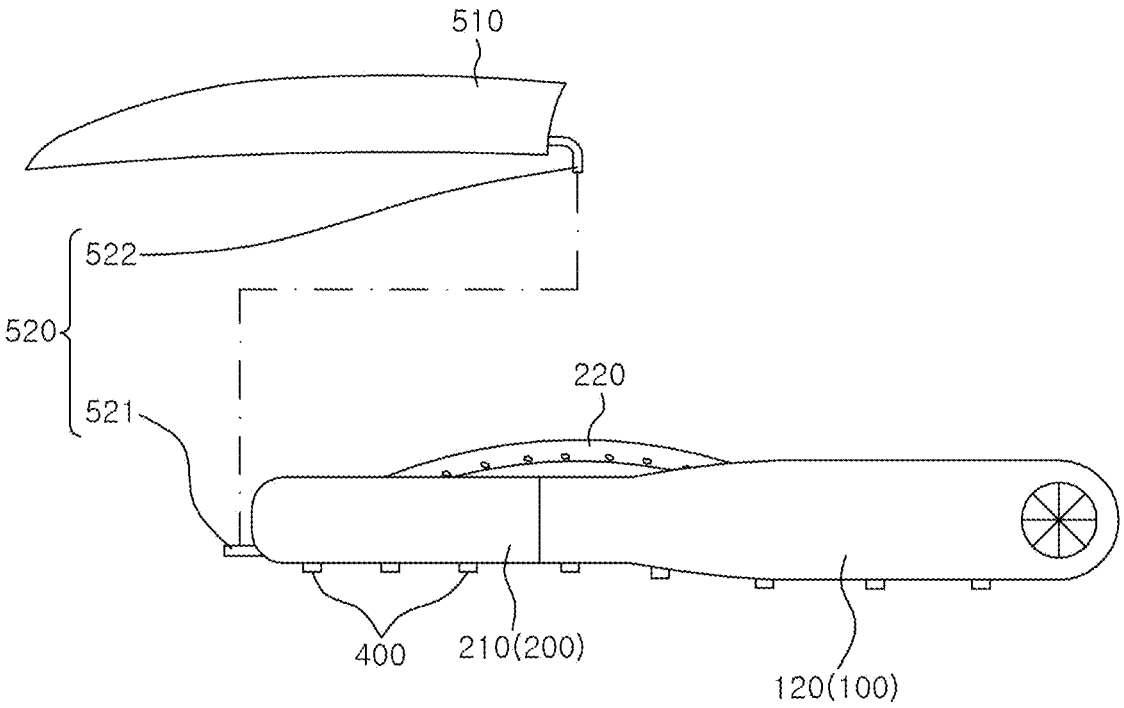
FIG. 5 is a side view showing a state in which a hat shade is coupled to the head mounted fan according to the first embodiment of the present disclosure.

Hereinafter, specific embodiments for implementing the idea of the present disclosure will be described in detail with reference to the drawings.

In addition, in the description of the present disclosure, if it is determined that a detailed description of a related known configuration or function may obscure the gist of the present disclosure, the detailed description thereof will be omitted.

Further, it should be understood that when it is mentioned that a component is 'coupled', 'supported', 'connected', 'supplied', 'transferred', or 'contacted' to another component, it may be directly coupled, supported, connected, supplied, transferred, or contacted to another component, but other component may exist therebetween.

The terms used herein are only used to describe specific embodiments and are not intended to limit the present disclosure. The singular expression includes the plural expression unless the context clearly expresses otherwise.

Further, in the present specification, the expressions of upper, lower, side, and the like are described based on the illustration in the drawings, and may be expressed differently if the orientation of the corresponding object is changed. For the same reason, some components are exaggerated, omitted, or schematically illustrated in the accompanying drawings, and the size of each component does not fully reflect the actual size.

Furthermore, the terms including ordinal numbers such as first, second, etc. may be used to describe various components, but the corresponding components are not limited by these terms. These terms are used only for the purpose of distinguishing one component from another.

The meaning of "comprising or including" as used herein, specifies a particular characteristic, region, integer, step, operation, element and/or component, and does not exclude the presence or addition of other particular characteristic, region, integer, step, operation, elements, component and/or group.

Hereinafter, a detailed configuration of a head mounted fan according to the present disclosure will be described.

As shown in FIGS. 1 to 5, a head mounted fan 10 according to a first embodiment of the present disclosure can effectively supply cool wind to the scalp in the hair of a user. The head mounted fan 10 may include a main blowing tube 100, a sub blowing tube 200, a wind generating unit 300, an elastic member 400, a hat shade 510, a clamping unit 520, a battery 600, and a control switch 700.

Specifically, the main blowing tube 100 may be provided in a round shape that can be mounted on the head of a user. As an example, the main blowing tube 100 may be in the form of a "U"-shaped headband that can be worn on the head.

An air inlet 102 through which air is introduced may be formed at an end of the main blowing tube 100. The air inlet 102 may be an air hole for introducing external air into the main blowing tube 100. When the wind generating unit 300 is operated, external air may be introduced into the main blowing tube 100 through the air inlet 102. A main flow path 101 through which air flows may be formed inside the main blowing tube 100. The main flow path 101 may guide the air introduced through the air inlet 102 to the sub blowing tube 200.

The main blowing tube 100 may include a first main blowing tube 110 and a second main blowing tube 120. One end of the first main blowing tube 110 may be detachably coupled to one end of the sub blowing tube 200. For example, one end of the first main blowing tube 110 may be rotationally coupled to one end of the sub blowing tube 200, or may be coupled to one end of the sub blowing tube 200 through an attachment/detachment unit. Here, the attachment/detachment unit may be a conventional attachment/detachment unit capable of coupling between tubes through an elastic switch. In addition, at the other end of the first main blowing tube 110, a first fan seating portion on which the wind generating unit 300 can be mounted and the air inlet 102 for suctioning air may be formed.

One end of the second main blowing tube 120 may be detachably coupled to the other end of the sub blowing tube 200. For example, one end of the second main air blower 120 may be rotationally coupled to the other end of the sub blowing tube 200 or coupled to the other end of the sub blowing tube 200 through a second conventional attachment/detachment unit. In addition, at the other end of the second main blowing tube 120, a second fan seating portion on which the wind generating unit 300 can be mounted and the air inlet 102 through which air is introduced may be formed.

A plurality of blowing holes 103 may be formed in the first main blowing tube 110 and the second main blowing tube 120. The blowing holes 103 may be air holes for discharging air in the main blowing tube 100 to the outside. Air in the main blowing tube 100 may be discharged to the outside through the blowing holes 103 when the wind generating unit 300 is operated. Since the blowing holes 103 are formed in sidewalls of the first main blowing tube 110 and the second main blowing tube 120 which are opposed to each other to face toward the scalp, the air in the main blowing tube 100 can be effectively discharged toward the scalp.

The sub blowing tube 200 may be detachably connected to an end of the main blowing tube 100. In order to blow air to the scalp, a part of the sub blowing tube 200 is inserted into the hairs, and when washing of the sub blowing tube 200 is necessary, by separating the sub blowing tube 200 from the main blowing tube 100, the separated sub blowing tube 200 can be washed.

In the present embodiment, the sub blowing tube 200 may be coupled to and fixed to the main blowing tube 100, but is not limited thereto. The sub blowing tube 200 may be mounted to the main blowing tube 100 to be rotatable in an up-down direction, so that it can be possible to adjust an angle with respect to the main blowing tube 100 in 2 and 3 steps.

In this way, if the sub blowing tube 200 is rotatable at an angle of 2 and 3 steps with respect to the main blowing tube 100 in the up-down direction, the sub blowing tube 200 can be brought as close to the scalp as possible in accordance with the shape of the head of a user even if shapes of the heads are different for users. As a result, when the sub blowing tube 200 is as close to the scalp as possible and air is discharged on the scalp through the sub blowing tube 200, even users with different head shapes can feel evenly the coolness on the scalps, and it can also be of great help to scalp health.

The sub blowing tube 200 may discharge the air supplied from the main blowing tube 100 toward the scalp. To this end, a sub flow path 201 communicating with the main flow path 101 may be formed in the sub blowing tube 200. A plurality of sub flow path 201 may be branched from the main flow path 101 to extend in one direction of the head.

The sub blowing tube 200 may include a sub tube part 210, an air discharge part 220, and a guide wall part 230. The sub tube part 210 may be disposed between the first main blowing tube 110 and the second main blowing tube 120. Both ends of the sub tube part 210 may be detachably coupled to the first main blowing tube 110 and the second main blowing tube 120. The air discharge part 220 may be connected to a rear wall of the sub tube part 210.

The air discharge part 220 of the sub blowing tube 200 may include a plurality of air discharge parts branching from the sub tube part 210 and extending toward a rear side of the head. For example, the air discharge part 220 includes a pair of first air discharge parts 220*a* extending in parallel from a central portion of the sub tube part 210 toward the rear side of the head, and a pair of second air discharge parts 220*b* extending from both ends of the sub tube part 210 in parallel toward the rear side of the head In this case, a plurality of air outlets 221 may be formed in sidewalls and end portions of the plurality of air discharge parts 220. The air outlets 221 may be air holes for discharging the air in the air discharge parts 220 to the outside. Air in the air discharge parts 220 may be discharged to the outside through the air outlets 221 when the wind generating unit 300 is operated. Since the air outlets 221 are formed in the sidewalls and the end portions of the air discharge parts 220 to face the scalp, the air in the air discharge parts 220 can be effectively discharged toward the scalp.

In the present embodiment, although four air discharge parts 220 are provided, the number and shape of the air discharge parts 220 is not limited thereto, and may be variously changed. For example, five to eight air discharge parts 220 may be connected to the main blowing tube 100. In addition, the air discharge parts 220 may be formed to be curved in the shape of a hair comb so as to be easily inserted into the hair.

The plurality of air discharge parts 220 may be connected to the sub tube part 210 to be rotatable in the up-down direction and/or left-right direction. As an example, a wrinkle portion may be formed between the plurality of air discharge parts 220 and the sub tube part 210. Accordingly, the user can rotate the plurality of air discharge parts 220 so that the air outlets 221 of the air discharge parts 220 face a desired point on the scalp.

The guide wall part 230 of the sub blowing tube 200 is formed to be curved in the sub tube part 210, so that the air introduced from the main blowing tube 100 can be guided to the air discharge parts 220. The guide wall part 230 includes a first guide wall part 230*a* provided in a center portion of the sub tube part 210 and a second guide wall part 230*b* provided at a branch point between the second air discharge part 220*b* and the sub tube part 210.

The first guide wall part 230*a* provides an inner wall that is curved so as to be continuous with an inner wall of the first air discharge part 220*a*, so that the air supplied from the main blowing tube 100 can be guided to the first air discharge part 220*a*. The second guide wall part 230*b* provides an inner wall that is curved to be continuous with an inner wall of the second air discharge part 220*b*, so that the air supplied from the main blowing tube 100 can be guided to the second air discharge part 220*b*.

The wind generating unit 300 may provide air pressure for causing air flow in the main blowing tube 100. For example, the wind generating unit 300 may be a plurality of fan motors installed at end portions of the main blowing tube 100, specifically, at the first fan seating portion of the first main blowing tube 110 and the second fan seating portion of the second main blowing tube 120, respectively, to face the air inlets 102. The wind generating unit 300 may suck air from the outside through the air inlets 102 into the main blowing tube 100, and may provide the sucked air to the main flow path 101 of the main blowing tube 100.

In the present embodiment, the wind generating unit 300 has been described as the fan motors installed at the end portions of the main blowing tube 100, but it is not limited thereto, and the wind generating unit 300 may be provided in various types and forms for causing air flow in the main blowing tube 100. For example, the wind generating unit 300 may be connected to the air inlets 102 through separate connection tubes while being located outside the main blowing tube 100.

The elastic member 400 may include a plurality of elastic members 400 provided at a lower surface of the main blowing tube 100 to be spaced apart from each other in a longitudinal direction. The plurality of elastic members 400 are positioned between the head mounted fan 10 and the head of a user, so that it is possible to minimize the impact due to the vibration of the head mounted fan 10.

The hat shade 510 may be formed in the shape of a cap visor for blocking sunlight. The hat shade 510 may be selectively attached and detached to a front portion of the main blowing tube 100 through the clamping unit 520. To this end, the clamping unit 520 may include a hole portion 521 and a ring portion 522. The hole portion 521 may be formed in a ring shape at the front portion of the main blowing tube 100. The ring portion 522 may be formed in a hook shape at a rear portion of the hat shade 510 so as to be fixed by being fitted into the hole portion 521.

The battery 600 may be provided in the main blowing tube 100 to supply power to the wind generating unit 300. The battery 600 may be electrically connected to an external power supply to be charged. To this end, the main blowing tube 100 may be provided with a USB terminal for electrically connecting the external power supply and the battery 600.

The control switch 700 may be electrically connected between the battery 600 and the wind generating unit 300. The control switch 700 may be a button for controlling an operation (wind strength) and on/off of the wind generating unit 300. For example, when the user presses the control switch 700 once, the wind generating unit 300 may be turned "on" and operated with a weak wind strength. When the user presses the control switch 700 twice in succession, the wind generating unit 300 may be operated with a strong wind strength. When the user presses the control switch 700 three times in succession, the wind generating unit 300 may be turned "off" to stop the operation.

In the present embodiment, when the control switch 700 is operated once and twice, the wind strength of the wind generating unit 300 is controlled, and when the control switch 700 is operated three times, the on/off of the wind generating unit 300 is controlled. However the present disclosure is not limited thereto, and the control of the operation and on/off of the wind generating unit 300 through the control switch 700 may be set in various ways.

The control switch 700 may be implemented by an arithmetic device including a microprocessor, a memory, or the like, and since the implementation method is obvious to those skilled in the art, further detailed description thereof will be omitted.

Figure 6:
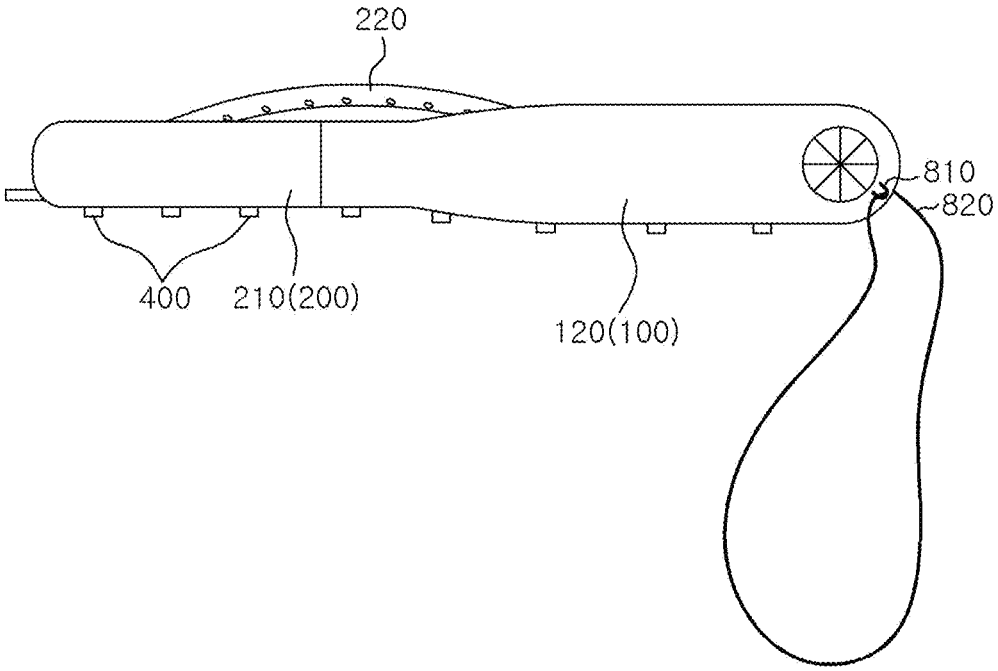
FIG. 6 is a side view showing a state in which a necklace strap is coupled to a head mounted fan according to a second embodiment of the present disclosure.

As shown in FIG. 6, a head mounted fan 10 according to a second embodiment of the present disclosure includes a main blowing tube 100, a sub blowing tube 200, a wind generating unit 300, an elastic member 400, a hat shade 510, a clamping unit 520, a battery 600, a control switch 700, a connecting ring 810, and a necklace strap 820.

In describing the second embodiment of the present disclosure, since there is a difference in that the second embodiment further includes the connecting ring 810 and the necklace strap 820 when compared with the above-described first embodiment, the description will be made mainly on the difference, and the same description and reference numerals as those in the above-described embodiment will be referred to.

The connecting ring 810 may include a pair of connecting rings 810 provided at both ends of the main blowing tube 100. Both ends of the necklace string 820 may be fixedly connected to the respective connecting rings 810.

The necklace string 820 can maintain the head mounted fan 10 separated from the head of a user while hanging on the neck by connecting the pair of connecting rings 810 to each other. Since the necklace string 820 is maintained on the user's neck, even if the head mounted fan 10 falls from the head, the head mounted fan 10 can be hung on the user's neck by the necklace string 820. As a result, it is possible to prevent damage to the head mounted fan 10 in advance.

Figure 7:
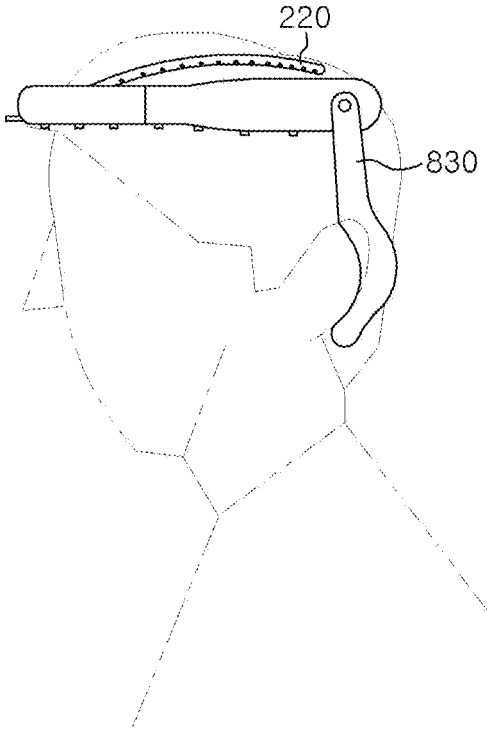
FIG. 7 is a side view illustrating a state in which an earring is coupled to a head mounted fan according to a third embodiment of the present disclosure.

As shown in FIG. 7, according to a head mounted fan 10 according to a third embodiment of the present disclosure, an earring bar 830 may be detachably installed at the ends of the main blowing tube 100. When the main blowing tube 100 is mounted on the head of a user, the earring bar 830 may be hung on the user's ear. The earring bar 830 may be rotated by a preset angle with respect to the end of the main blowing tube 100 to be hung on the user's ear.

The earring bar 830 may be manufactured in various sizes to fit sizes of heads of users. A user may select an earring bar suitable for the user among the earring bars 830 of various sizes and mount it on the main blowing tube 100.

Hereinafter, a head mounted fan according to a fourth embodiment of the present invention will be described with reference to FIGS. 8 to 12. In describing the fourth embodiment of the present disclosure, the differences compared to the above-described first to third embodiments will be mainly described, and the same description and reference numerals as those in the above-described first to third embodiments will be referred to. In addition, in describing the fourth embodiment of the present disclosure, front-back, left-right, and up-down directions may be defined as the same directions as the front-back, left-right, and up-down directions shown in FIG. 8.

Figure 8:
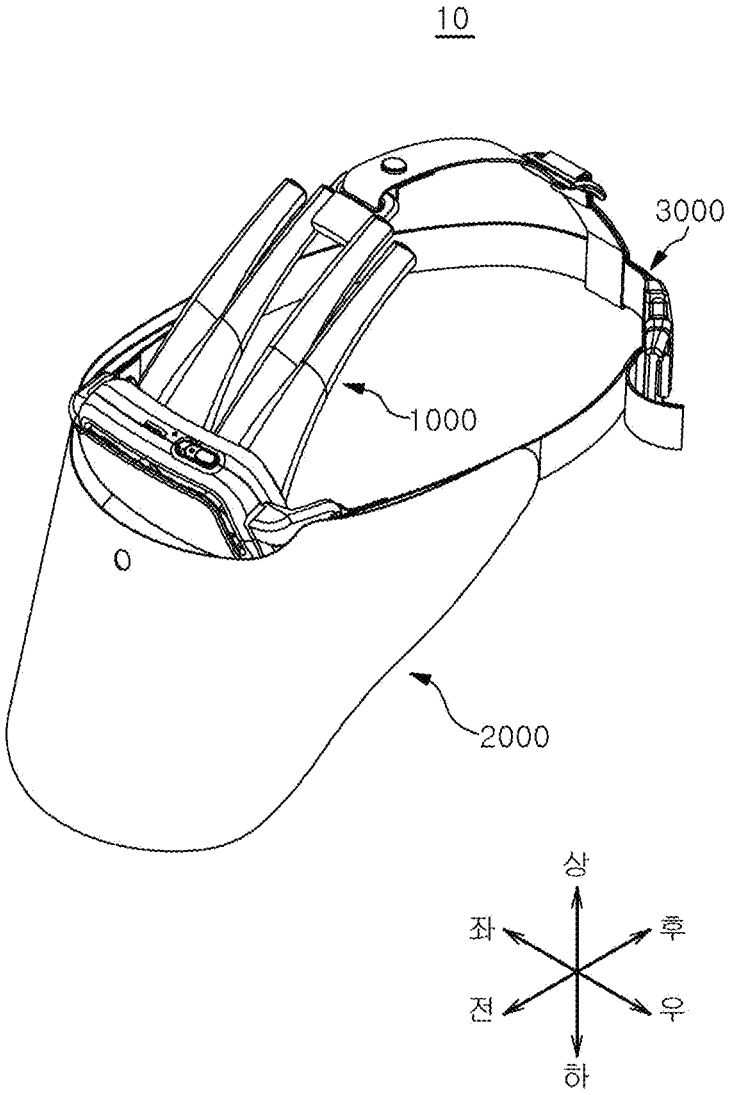
FIG. 8 is a perspective view showing a head mounted fan according to a fourth embodiment of the present disclosure.
Figure 9:
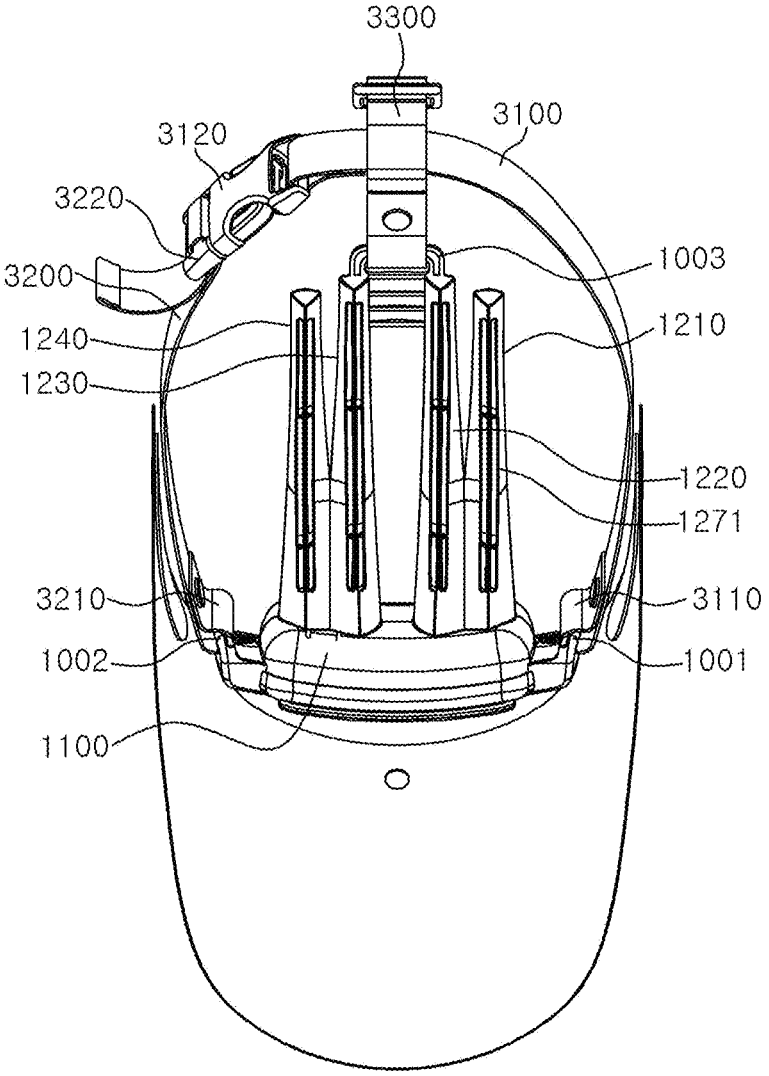
FIG. 9 is a bottom view of the head mounted fan according to the fourth embodiment of the present disclosure.
Figure 10:
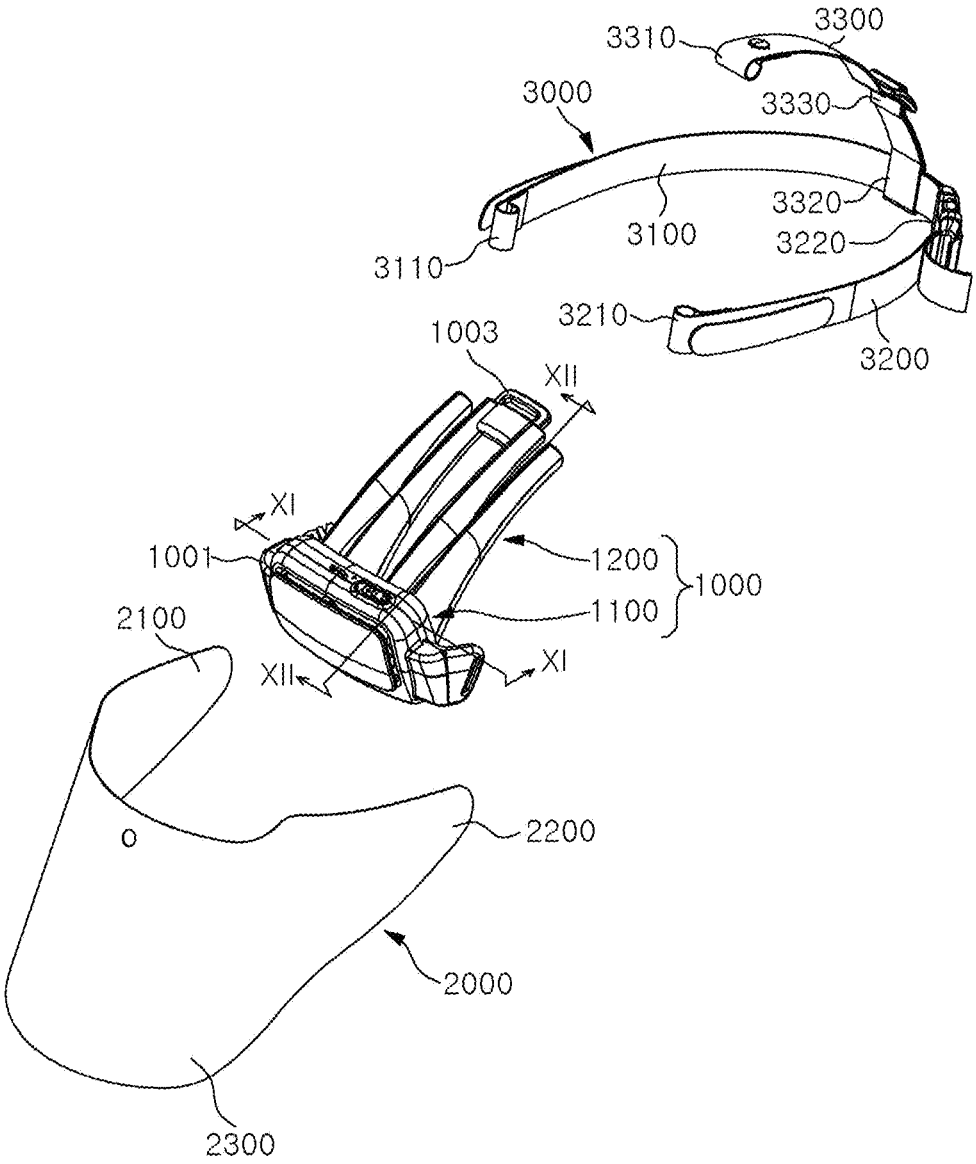
FIG. 10 is an exploded perspective view of the head mounted fan according to the fourth embodiment of the present disclosure.

As shown in FIGS. 8 to 10, the head mounted fan 10 according to the fourth embodiment of the present disclosure may include a blowing unit 1000, a hat shade 2000, and a headband 3000.

The hat shade 2000 may be attached to the blowing unit 1000 to block sunlight to a user's face. The hat shade 2000 may be formed by processing an elastic material having an approximately elliptical shape whose length in the left-right direction is longer than the length in the up-down direction to maintain a curved shape in which both ends in the left-right directions get closer to each other. Referring to FIG. 10, the hat shade 2000 may include a first shade end part 2100, a second shade end part 2200, and a shade body part 2300, and one end of the first shade end part 2100 and one end of the second shade end part 2200 are connected to the shade body part 2300, the other end of the first shade end part 2100 and the other end of the second shade end part 2200 may be spaced apart from each other. The other end portion of the first shade end part 2100 and the other end portion of the second shade end part 2200 may be parallel to each other or curved at a preset angle in a direction closer to the center of the shade body part 2300.

The hat shade 2000 may be selectively detached and attached to a front portion of the blowing unit 1000. Specifically, when the hat shade 2000 is attached to the front portion of the blowing unit 1000, the attachment may be completed by applying force in the direction that the first shade end part 2100 and the second shade end part 2200 move away from each other and placing the front portion of the blowing unit 1000 between the first shade end part 2100 and the second shade end part 2200. The hat shade 2000 may be maintained in a state attached to the front portion of the blowing unit 1000 with a restoring force for maintaining the shape thereof.

When the hat shade 2000 is detached from the front portion of the blowing unit 1000, detachment can be completed by moving the hat shade 2000 away from the blowing unit 1000 with a certain force.

In this way, the hat shade 2000 according to the fourth embodiment of the present disclosure may be selectively detached and attached to the front portion of the blowing unit 1000 without a separate engaging means.

The headband 3000 may be combined with the blowing unit 1000 so that the head mounted fan 10 is mounted on and held on the head of a user. The headband 3000 may include a first band 3100, a second band 3200, and a third band 3300. When the head mounted fan 10 is mounted on the user's head, the first band 3100 and the second band 3200 may hold the head mounted fan 10 not to be separated laterally from the user's head, and the third band 3300 may hold the head mounted fan 10 not to be separated upward from the user's head.

To this end, the first band 3100, the second band 3200, and the third band 3300 include a first engaging part 3110, a second engaging part 3210, and a third engaging part 3310, respectively, and the first engaging part 3110, the second engaging part 3210, and the third engaging part 3310 may be engaged with a first engaged part 1001, a second engaged part 1002, and a third engaged part 1003 provided in the blowing unit 1000, respectively.

The first band 3100 may include the first engaging part 3110 and a first buckle part 3120 at both ends thereof, respectively. The second band 3200 may include the second engaging part 3210 and a second buckle part 3220 at both ends thereof, respectively. The first buckle part 3120 and the second buckle part 3220 can be attached to and detached from each other, and the user can easily attach and detach the head mounted fan 10 to the head through attachment/detachment of the first buckle part 3120 and the second buckle part 3220.

The third band 3300 may include the third engaging part 3310 and a band connecting part 3320 at both ends thereof, respectively. The band connecting part 3320 may be connected to the first band 3100 or the second band 3200.

A band length adjusting part may be provided in at least one of the first band 3100 and the second band 3200, and the third band 3300. The user can adjust the head mounted fan 10 to be stably held on the head through the band length adjusting part.

The blowing unit 1000 may include a fan part 1100 and a hairpin part 1200. The fan part 1100 may provide air pressure for causing air flow in the hairpin part 1200.

The fan part 1100 may include a fan housing 1110, a motor 1120, a fan 1130, a battery 1140, and a controller 1150.

The fan housing 1110 may have a substantially rectangular parallelepiped shape, surround the motor 1120, the fan 1130, the battery 1140, and the controller 1150, and provide an accommodation space for accommodating these components. An air inlet 1111 through which external air can be introduced into an interior of the fan housing 1110 may be provided at a front portion of the fan housing 1110, and a rear portion of the fan housing 1110 may be opened to communicate with an air flow space of the hairpin part 1200.

The motor 1120 and the fan 1130 connected to the motor 1120 may be disposed in a central portion of the accommodating space of the fan housing 1110, the battery 1140 may be disposed in a lower portion of the accommodating space of the fan housing 1110, and the controller 1150 may be disposed in the lower portion of the accommodating space of the fan housing 1110.

The first engaged part 1001 and the second engaged part 1002 may be provided at both ends of the fan housing 1110 in the left-right directions, respectively, and the first engaged part 1001 and the second engaged part 1002 may be engaged with the first engaging part 3110 and the second engaging part 3210 of the headband 3000, respectively.

The motor 1120 may receive power from the battery 1140 and drive the fan 1130 based on a control operation of the controller 1150. The motor 1120 includes a motor shaft AX, and the motor shaft AX may extend in a direction parallel to a thickness direction of the fan housing 1110. The thickness direction of the fan housing 1110 may be substantially parallel to the front-rear direction of the head mounted fan 10.

The fan 1130 receives a driving force from the motor 1120 and introduces external air into the fan housing 1110 through the air inlet 1111 to flow to the hairpin part 1200 through an air outlet 1112.

The controller 1150 may control driving of the motor according to the user's input. For example, the controller 1150 may be configured to control a rotation speed of the fan, a rotation time of the fan, and the like.

The hairpin part 1200 has a substantially hollow truncated cone or polygonal truncated cone shape, and may discharge air transferred from the fan unit 1100 toward the user's head. The hairpin part 1200 may be connected to a rear portion of the fan part 1100, and may have a shape that is tapered toward the rear side of the head mounted fan 10. In addition, the hairpin part 1200 may be formed to have a preset curvature, and may have a shape surrounding a user's head according to a shape of the user's head when mounted on the user's head.

The hairpin part 1200 may include a plurality of air outlets 1271 in a bottom surface thereof. The plurality of air outlets 1271 are openings through which the inside of the hairpin part 1200 communicates with the outside, and may be disposed along an extension direction of the hairpin part 1200. Although the air outlets 1271 formed in two rows in the extension direction of the hairpin part 1200 in one hairpin part 1200 are disclosed in FIG. 9, the shape and arrangement of the air outlets 1271 is not limited thereto.

The hairpin part 1200 may include a flow path guide 1260 for guiding the air introduced into the hairpin part 1200 to be discharged to the outside through the air outlets 1271. The flow path guide 1260 may protrude from an inner wall of the hairpin part 1200 toward the inside of the hairpin part 1200 in a thickness direction of the hairpin part 1200. The flow guide 1260 may be formed in a substantially lower portion of a cross section when the hairpin part 1200 is cut in the thickness direction.

For example, a range of the flow path guide 1260 in the up-down direction may be a range from a position approximately corresponding to a flow path center line CL to a position corresponding to the bottom surface of the hairpin part 1200. Here, the flow path center line CL may be defined as a line formed by connecting the centers of cross-sections of the hairpin part 1200 cut in the thickness direction from a bottom line BL of the hairpin part 1200. The extension direction of the hairpin part 1200 and the thickness direction of the hairpin part 1200 may be substantially perpendicular to each other.

As described above, by forming the flow path guide 1260 in the lower portion of an inner space of the hairpin part 1200, some of the air introduced into the hairpin part 1200 may flow downstream through an upper side of the flow path guide 1260 without being restricted by the flow path guide 1260, and the remaining of the air may be guided by the flow path guide 1260 to flow toward the air outlets 1271 positioned at the lower side in the hairpin part 1200.

Here, in the hairpin part 1200, a space in which the main flow path extending along a length direction of the hairpin part in the upper side of the flow path guide 1260 is formed may be defined as a main blowing tube 1290. In addition, a sub blowing tube 1250 may be defined as a space in which a plurality of sub-channels that are connected to the main blowing tube 1290 and branched from the main blowing tube 1290 to extend in one direction of the user's head when worn by the user are formed therein, and air is injected toward the scalp of the head through a plurality of air outlets communicating with the sub flow path. Further, a flow path flowing through the flow path guide 1260 and the air outlets 1271 may be defined as a sub flow path.

In addition, the sub blowing tube 1250 may include: a sub tube part 1280 connected to the main blowing tube 1290; an air discharge part 1270 branched in one direction of the head from the sub tube part 1280 and including a plurality of air outlets 1271; and a flow path guide 1260 formed to guide the air introduced from the main blowing tube 1290 to the air discharge part 1270.

The hairpin part 1200 may have a shape that is tapered toward a rear side thereof. Accordingly, the airflow space inside the hairpin part 1200 becomes smaller toward the rear side of the hairpin part 1200. Meanwhile, the pressure of the air transferred by the blowing of the fan 1130 may be higher in the front space of the hairpin part 1200 having a relatively close distance to the fan 1130 than in the rear space. However, as the front space of the hairpin part 1200 is wider than the rear space, the pressure difference of the air inside the hairpin part 1200 according to the distance from the fan 1130 may be reduced.

That is, due to the arrangement of the flow path guide 1260 and the shape of the hairpin part 1200 that is tapered toward the rear side, the air flow rate discharged through the plurality of air outlets 1271 formed over the entire length of the hairpin part 1200 may be generally uniform.

Figure 12:
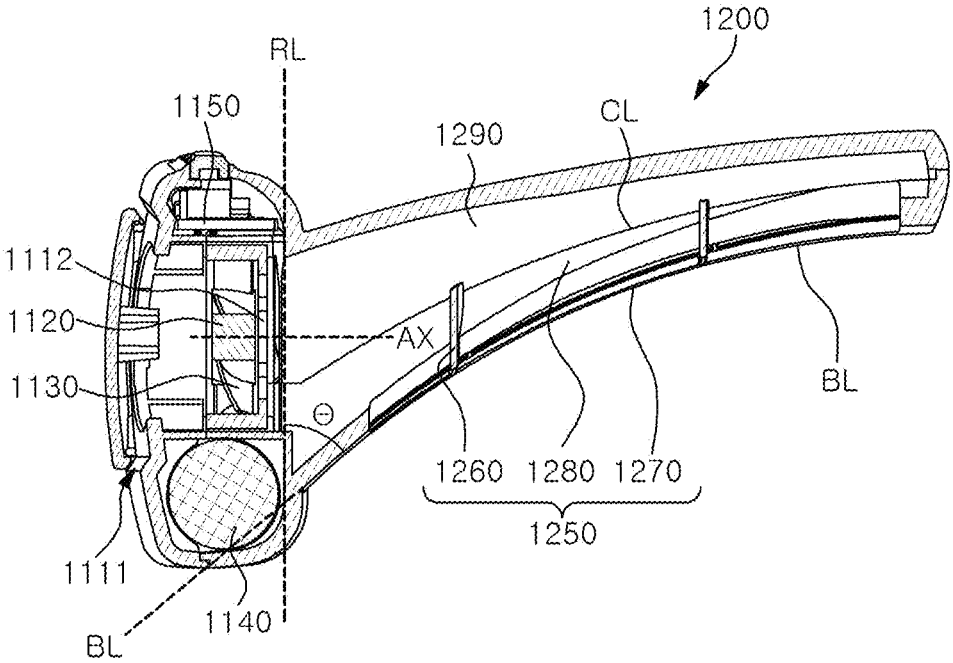
FIG. 12 is a cross-sectional view of the fan unit taken along line XII-XII shown in FIG. 10.

Referring to FIG. 12, in a surface where the fan part 1100 and the hairpin part 1200 are connected, the flow path center line CL may be disposed below a rotation axis AX of the motor 1120, and an angle between the bottom line BL of the hairpin part 1200 and a rear line RL of the fan part 1100 may be formed as an acute angle.

The hairpin part 1200 may include a plurality of hairpin parts 1200, and the plurality of hairpin parts 1200 may be connected to a rear surface of the fan part 1100 at certain intervals in the left-right direction. The third engaged part 1003 may be provided at two hairpin parts 1200 adjacent to each other in the center in the left-right direction among the plurality of hairpin parts 1200. The third engaged part 1003 may be engaged with the third engaging part 3310 of the headband 3000.

Figure 11:
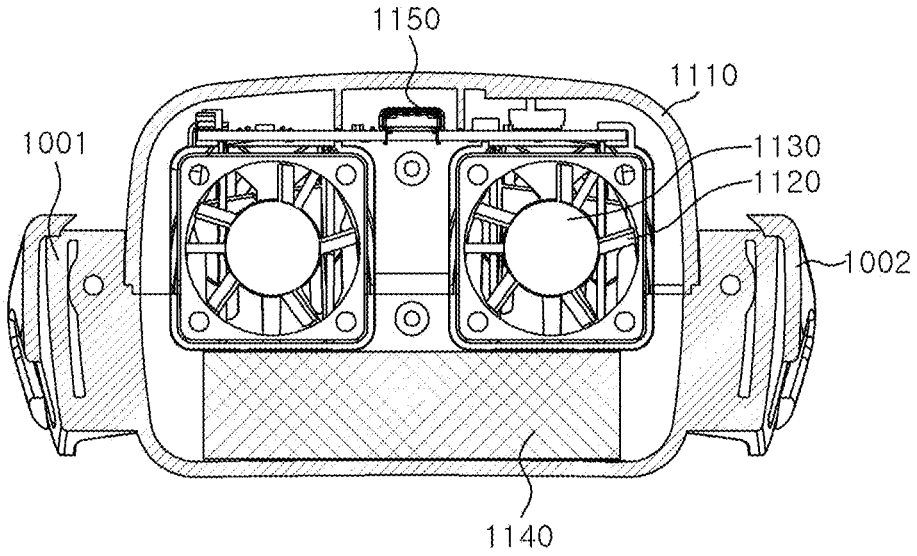
FIG. 11 is a cross-sectional view of a fan unit taken along line XI-XI shown in FIG. 10.

For example, referring to FIGS. 9 and 11, the hairpin part 1200 may include a first hairpin 1210, a second hairpin 1220, a third hairpin 1230, and a fourth hairpin 1240. The first hairpin 1210 to the fourth hairpin 1240 may be arranged in the left-right direction on the rear surface of the fan part 1100 in that order. Meanwhile, the fan part 1100 may include two fans 1130, and the first hairpin 1210 and the second hairpin 1210 may be connected to one of the two fans 1130, and the third hairpin 1230 and the fourth hairpin 1240 may be connected to the other of the two fans 1130.

In addition, a distance between the second hairpin 1210 and the third hairpin 1230 may be greater than a distance between the first hairpin 1210 and the second hairpin 1210 or a distance between the third hairpin 1230 and the fourth hairpin 1240.

Further, an are of a region where the hairpin part 1200 and the fan part 1100 cross may be smaller than a cross-sectional area of the fan part 1100.

Hereinafter, the operation and effect of the head mounted fan having the above-described configuration will be described.

Referring again to FIG. 2, the head mounted fan 10 according to the present disclosure may be mounted on a user's head. In this case, the air discharge part 220 of the head mounted fan 10 may be inserted into the hairs and positioned as close to the scalp as possible.

When the head mounted fan 10 is stably mounted on the head, the user may operate the control switch 700 to supply cool air to the scalp. For example, according to the number of times the user presses the control switch 700, the wind strength may be adjusted, or the operation may be turned "on" or "off". In particular, when the head mounted fan 10 is used outdoors, the hat shade 510 may be attached to the front portion of the main blowing tube 100 to protect the user's face from sunlight.

In addition, referring back to FIG. 6, when the connecting ring 810 and the necklace strap 820 are mounted to the head mounted fan 10, even if the head mounted fan 10 falls from the head, since the head mounted fan 10 is hung on the user's neck by the necklace strap 820, it is possible to prevent damage to the head mounted fan 10 in advance.

Further, referring back to FIG. 7, when the earring bar 830 is mounted to the head mounted fan 10, when the head mounted fan 10 is mounted on the head, the user puts the earring bar 830 on the user's ear so that the head mounted fan 10 can be stably mounted on the head.

Furthermore, referring to FIG. 8, the hat shade 2000 can be attached to the front portion of the blowing unit 1000 without a separate attachment member to block sunlight to the user's face, and the head mounted fan 10 can be stably mounted on the user's head using the headband 3000. Moreover, by disposing the blowing unit 1000 at a position spaced apart from the ear, it is possible to prevent noise due to the driving of the fan 1130 of the blowing unit 1000 from being transmitted to the user. In addition, when the headband 3000 needs to be washed, the headband 3000 can be easily separated from the blowing unit 1000 to be washed. As described above, since the present disclosure can send cool wind directly to the scalp through the air discharge part of the sub blowing tube inserted into the hairs, the user can feel cool on the scalp, and it can also be of great help to the user's scalp health.

Although the embodiments of the present disclosure have been described as specific embodiments, these are merely examples. The present disclosure is not limited thereto and should be construed as having the widest scope according to the technical idea disclosed in the present specification. Those skilled in the art may implement a pattern of a shape not specified above by combining/substituting the disclosed embodiments, without departing from the scope of the present disclosure. In addition, those skilled in the art may easily change or modify the embodiments disclosed based on the present specification, and it is clear that such changes or modifications also fall within the scope of the present disclosure.

What is claimed is:

1. A head mounted fan, comprising:

a main blowing tube configured to be mounted on an upper portion of a head of a user, the main blowing tube having an air inlet through which air is introduced and including a main flow path through which air flows therein;

a sub blowing tube connected to the main blowing tube, the sub blowing tube includes a plurality of sub flow paths branching from the main flow path to extend in one direction of the head when the head mounted fan is worn on the head, and wherein air is discharged toward a scalp of the head through a plurality of air outlets communicating with the sub flow paths; and a wind generating unit configured to provide air pressure for causing the air to flow in the main flow path.

2. The head mounted fan of claim 1, further comprising:

a plurality of elastic members disposed to be spaced apart from each other in a longitudinal direction on a lower surface of the main blowing tube to be located in a space between the head and the main blowing tube, wherein the wind generating unit is installed in an end portion of the main blowing tube to face the air inlet.

3. The head mounted fan of claim 1, further comprising:

a hat shade configured for blocking sunlight; and a clamping unit configured to attach the hat shade to a front portion of the main blowing tube, wherein the clamping unit includes:

a hole portion provided at the front portion of the main blowing tube; and a ring portion provided at a rear portion of the hat shade and configured to be fixed by being fitted into the hole portion.

4. The head mounted fan of claim 1, further comprising:

a pair of connecting rings provided at both ends of the main blowing tube; and a necklace strap connecting the pair of connecting rings to each other to maintain the head mounted fan separated from the head hung on the neck of the user.

5. The head mounted fan of claim 1, further comprising:

an earring bar installed at an end of the main blowing tube to be hung on an ear of the user when the main blowing tube is mounted on the head.

6. The head mounted fan of claim 1, further comprising:

a battery provided in the main blowing tube to supply power to the wind generating unit; and a control switch electrically connected between the battery and the wind generating unit to control an operation and on/off of the wind generating unit.

7. The head mounted fan of claim 1, wherein the sub blowing tube includes:

a sub tube part connected to the main blowing tube;

an air discharge part branched in one direction of the head from the sub tube part, and including a plurality of air outlets; and a guide wall part formed to guide air introduced from the main blowing tube to the air discharge part.

8. The head mounted fan of claim 7, wherein the air discharge part includes:

a pair of first air discharge parts extending from a central portion of the sub tube part in parallel toward a rear side of the head; and a pair of second air discharge parts extending from both ends of the sub tube part in parallel toward the rear side of the head, and wherein the guide wall part includes:

a first guide wall part provided at a center of the sub tube part, and providing an inner wall that is curved to be continuous with an inner wall of each of the first air discharge parts to guide the air from the main blowing tube to the first air discharge parts; and a second guide wall part provided at a point of the sub tube part from which each of the second discharge parts branches and providing an inner wall that is curved to be continuous with an inner wall of each of the second discharge parts to guide the air from the main blowing tube to the second discharge parts.

9. The head mounted fan of claim 7, wherein the sub blowing tube is mounted at the main blowing tube to be rotatable in an up-down direction.

10. The head mounted fan of claim 7, wherein the main blowing tube includes:

a first main blowing tube coupled to one end of the sub blowing tube and providing a first fan seating portion to which the wind generating unit is mounted; and a second main blowing tube coupled to the other end of the sub blowing tube and providing a second fan seating portion to which the wind generating unit is mounted, and wherein a plurality of blowing holes for discharging air toward the scalp of the head are formed in the first main blowing tube and the second main blowing tube.

* * * * *